US011992110B1

(12) United States Patent
Elliott

(10) Patent No.: US 11,992,110 B1
(45) Date of Patent: May 28, 2024

(54) HAIR TOOL

(71) Applicant: Velma Elliott, Florence, SC (US)

(72) Inventor: Velma Elliott, Florence, SC (US)

( * ) Notice: Subject to any disclaimer, the term of this patent is extended or adjusted under 35 U.S.C. 154(b) by 0 days.

(21) Appl. No.: 18/507,652

(22) Filed: Nov. 13, 2023

Related U.S. Application Data

(63) Continuation-in-part of application No. 17/670,916, filed on Feb. 14, 2022, now abandoned.

(51) Int. Cl.
*A45D 8/00* (2006.01)
*A45D 7/00* (2006.01)

(52) U.S. Cl.
CPC ..... *A45D 8/001* (2021.01); *A45D 2007/004* (2013.01)

(58) Field of Classification Search
CPC ..... B26B 5/003; A45D 2002/005; A45D 2002/007; A45D 2002/008; A45D 2007/004
See application file for complete search history.

(56) References Cited

U.S. PATENT DOCUMENTS 1,092,529 A * 4/1914 Horn ..... D05B 81/00 223/104
2,586,505 A * 2/1952 Beverino ..... D05B 87/00 223/102
2,807,945 A 10/1957 Carlson
3,421,522 A * 1/1969 Magguilli ..... A45D 24/007 D28/24
3,882,804 A * 5/1975 Matsumura ..... D05C 15/02 28/115
7,284,557 B1 10/2007 Williams
7,958,583 B1 * 6/2011 Heffner ..... D05B 89/00 7/158
D842,066 S * 3/2019 Bloch ..... D8/98
2017/0196288 A1 * 7/2017 Taylor ..... A41G 5/0086
2021/0037943 A1 * 2/2021 McBride ..... A45D 2/00

FOREIGN PATENT DOCUMENTS

GB 1518859 * 12/1975

* cited by examiner

*Primary Examiner* — Nicholas D Lucchesi
*Assistant Examiner* — Jennifer Gill
(74) *Attorney, Agent, or Firm* — Sanchelima & Associates, P.A.; Christian Sanchelima; Jesus Sanchelima

(57) ABSTRACT

A hair tool including a needle assembly, a handle assembly and a knife assembly. The needle assembly has a harpoon that can catch multiple threads of a spool of threads. When pulling the needle the harpoon tip is covered by a hingedly mounted flap to allow the needle to be pulled back without catching additional threads of hair. The handle has a narrow portion that receives a threaded portion of the needle. The handle has a meshed textured surface for a better griping. The knife assembly includes a dull edged knife that can be used to split the threads or remove threads off of the harpoon portion of the needle.

10 Claims, 5 Drawing Sheets

HAIR TOOL

BACKGROUND OF THE INVENTION

Other Related Applications

The present application is a continuation-in-part of pending U.S. patent application Ser. No. 17/670,916, filed on Feb. 14, 2022, which is hereby incorporated by reference.

FIELD OF THE INVENTION

The present invention relates to a hair tool and, more particularly, to a hair tool that weaves hair with a needle attached to a handle. The needle has a harpoon tip with a flap and the handle is a hollow rectangular tapered body with a meshed textured outer surface. The tool also comprises a dull-edged knife used to split the threads or remove threads off of the harpoon portion of the needle.

DESCRIPTION OF THE RELATED ART

Several designs for hair weaving tools have been designed in the past. None of them, however, include a harpoon tip at one end of the needle along with a flap and a dull edge knife.

Applicant believes that a related reference corresponds to U.S. Pat. No. 7,284,557 issued for a hair styling tool. The "557" reference, discloses a hair styling tool for performing weaves without leaving a bulky and unkempt look and without damaging hair including a housing having a plurality of compartments formed therein. The hair styling tool includes a plurality of hair styling tools each having interior ends and exterior ends. The interior ends are pivotally coupled with the housing whereby each of the hair styling tools being removably positionable within the plurality of compartments in a closed orientation. Each of the plurality of hair styling tools have a styling tool portion disposed on the exterior ends thereof.

Applicant believes that another related reference corresponds to U.S. Pat. No. 3,882,804 issued for a two hook sewing machine needle for rooting hair and an apparatus for rooting hair. The "804" reference, teaches a two hook needle for rooting hair or similar substances in a material. The needle has a sharp tip end and two hooks, one provided in an area adjacent the tip end of the needle and the other in an area intermediate the head and the tip end thereof. The hooks can either be on the same side or on opposite sides of the needle. An apparatus for rooting any length of hair or similar substance in material easily and mechanically uses the hooked needle and a pair of cooperating guide plates or a guide ring.

Applicant believes that another related reference corresponds to U.S. patent publication No. 20210037943 published for a hair crochet apparatuses and methods. The "943" reference, teaches ann apparatus for crocheting hair that can be used to efficiently and safely crochet hair extensions into cornrow braids. The apparatus can include a handle comprising a first end, a second end, and a connection receptacle located proximate to an attachment receptacle. The handle can further comprise the attachment receptacle located at the first end of the handle and configured to receive an attachment feature of the detachable member, as well as a cavity located within the handle comprising an opening located at the second end of the handle. The attachment feature located at the first end of the detachable member.

Applicant believes that another related reference corresponds to U.S. Pat. No. 2,807,945 issued for a knitting needle and pick-up pin combination. The "945" reference, teaches a knitting needle with tapered handle and including a mesh style gripping structure in order to enable better handling during use.

None of these references, however, teach of a hair tool comprising a needle attached to a frustoconical handle, wherein the handle has a meshed outer surface and a knife assembly including a dull knife attached to a base, whin in turn, includes 4 flexible prongs configured to be inserted in the central opening of a spool of thread. The needle having a harpoon-shaped tip that is covered by means of a flap hingedly attached to the needle, wherein the flap is proximal to the harpoon shaped tip.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a hair tool to weave hair.

It is another object of this invention to provide a hair tool that when pulling the needle back the harpoon tip is covered by a flap mounted via a hinge to allow the needle to be pulled back without catching additional threads or hair.

It is still another object of the present invention to provide a hair tool that has a dull edged knife that can be used to split the threads or remove threads off of the harpoon portion of the needle.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
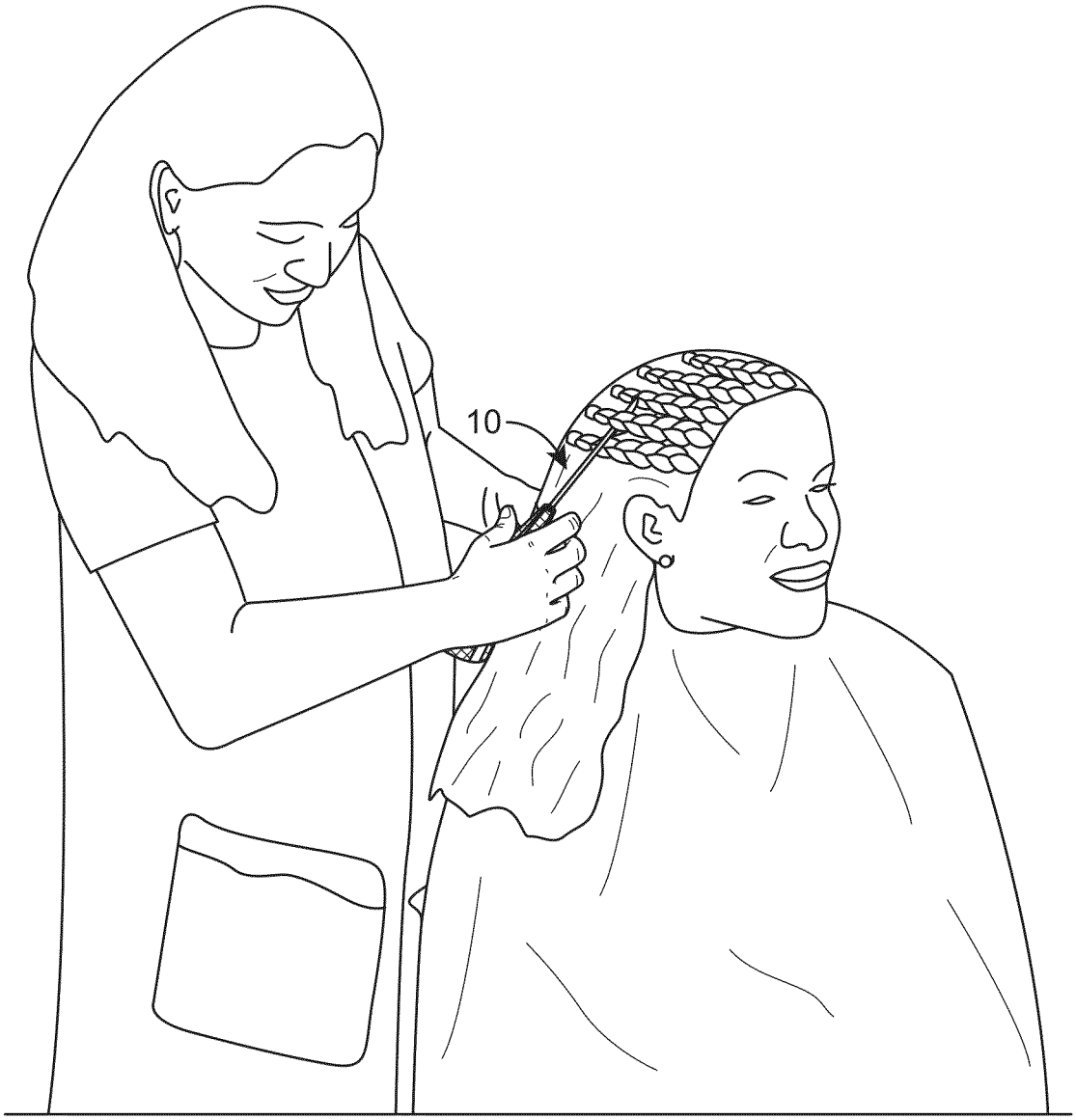
FIG. 1 represents an isometric operational view of the present invention 10 according to one embodiment.

Referring now to the drawings, where the present invention is generally referred to with numeral 10, it can be observed that it basically includes a needle assembly 20, a handle assembly 40, and a knife assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
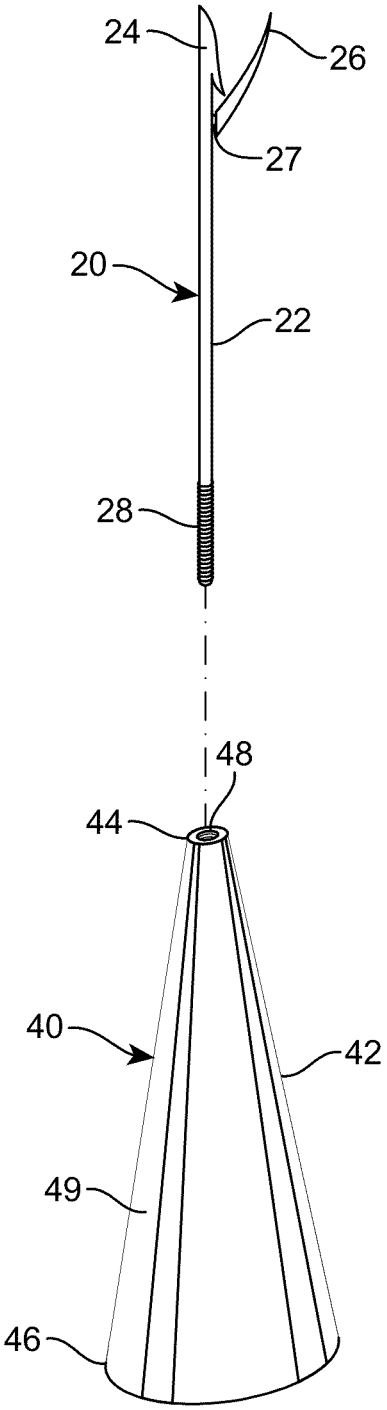
FIG. 2 shows an exploded view of elements 20 and 40 according to an exemplary embodiment.
Figure 3A:
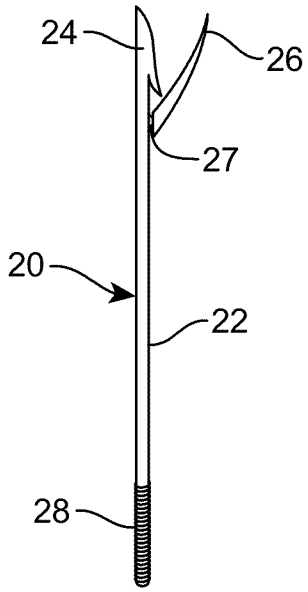
FIG. 3A-3B illustrate a closed and open configuration of the present invention according to some exemplary embodiments.
Figure 3B:
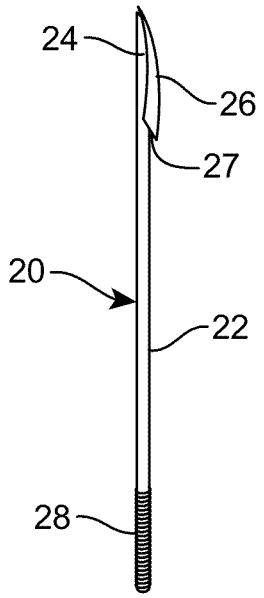

Best illustrated in FIGS. 1 and 2, the needle assembly 20 includes a needle 22 having two opposing distal ends, a first distal end and a second distal end. The needle 22 may be made of plastic, wood, bamboo, metal, aluminum, or any other variation thereof. The needle 22 may have a substantially cylindrical shape. Nonetheless, it should be understood that the needle 22 may have any shape or form available in the art. The length of the needle 22 may vary to meet various operational requirements. At the first distal end, the needle 22 may have a tip integrally mounted thereon. The tip may be a harpoon tip 24. The harpoon tip 24 may be made of plastic, wood, bamboo, metal, aluminum, or any other variation thereof. The harpoon tip 24 may be made of the same material of the needle 22. The harpoon tip 24 may engage multiple threads 102 from a spool 101. The present invention includes a flap 26 hingedly connected to the needle 22, proximal to the harpoon 24 by means of a hinge 27 disposed at a bottom end of the flap 26. The flap 26 may be made of plastic, wood, bamboo, metal, aluminum, or any other variation thereof. The flap 26 may also be made of the same material of the needle 22. The flap 26 may have an elongated and curved shape with a sharp top distal end. The hinge 27 can be any type of hinge available in the art. As illustrated in FIG. 3A-3B, the flap 26 has a closed and opened configuration respectively. In the open configuration showcased in FIG. 3B the harpoon 24 is exposed for it to catch threads. In the closed configuration outlined in FIG. 3A the flap 26 may cover the harpoon tip 24, preventing it from catching additional threads of hair. At the second distal end of the needle 22, the needle 22 may have a threaded portion 28. The threaded portion 28 starts at the beginning of the second distal end of the needle 22 and goes up to a point apart from the mounted flap 26, leaving a smooth middle part of the needle 22.

The handle assembly 40 includes a handle 42. In one embodiment, the handle 42 may have a truncated conical shape for comfort. However, in different embodiments, the handle 42 may have any other ergonomic shape from the art. The handle 42 may have a tapered body. The handle 42 may be made of plastic, wood, bamboo, metal, aluminum, or any other variation thereof. The tapered body may include four side walls, a first side wall, a second side wall, a third side wall and a forth side wall. The first side wall may include a meshed texture surface 49 to allow for a better grip and hand breathability when the hair tool 10 is being used. The second side wall may include the meshed texture surface 49 to allow for a better grip and hand breathability when the hair tool 10 is being used. The third side wall may include the meshed texture surface 49 to allow for a better grip and hand breathability when the hair tool 10 is being used. The forth side wall may include a meshed texture surface 49 to allow for a better grip and hand breathability when the hair tool 10 is being used. The tapered body of the handle 42 may further have an upper end and a lower end. The upper end may have a narrow portion 44. The narrow portion 44 may be solid, and may have a threaded hole 48 centered of a top wall of the narrow portion 44. The needle 22 is received and threaded into the threaded hole 48 of the narrow portion 44 of the handle 42. The lower end may have a bottom portion 46. The bottom portion 46 may be the wider portion of the tapered body. The handle 42 may be hollow.

Figure 4:
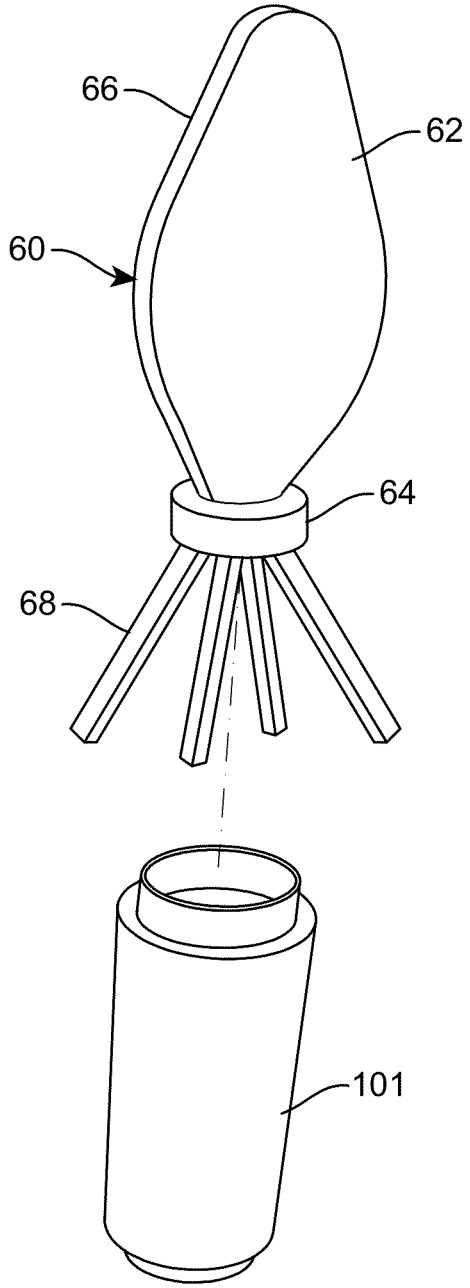
FIG. 4 illustrates an exploded view of elements 40 and 60 according to an exemplary embodiment.
Figure 5:
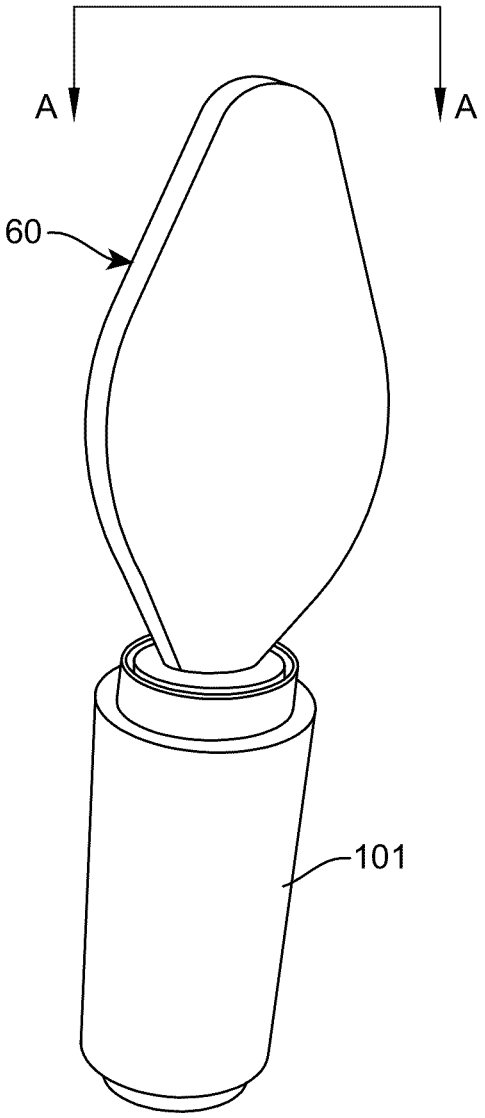
FIG. 5 is a representation of an isometric view of element 60 attached to 101.
Figure 6:
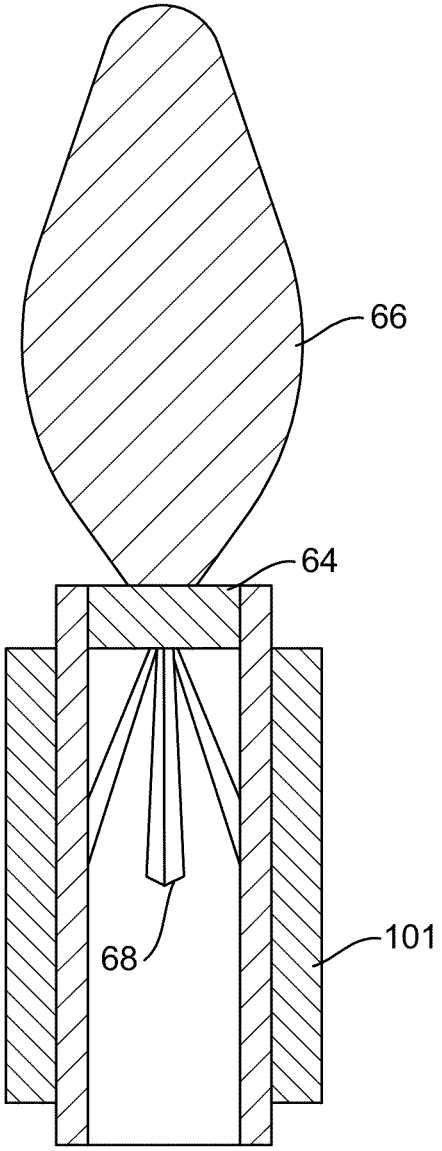
FIG. 6 is a cross sectional view of the present invention from lines A-A.
Figure 7:
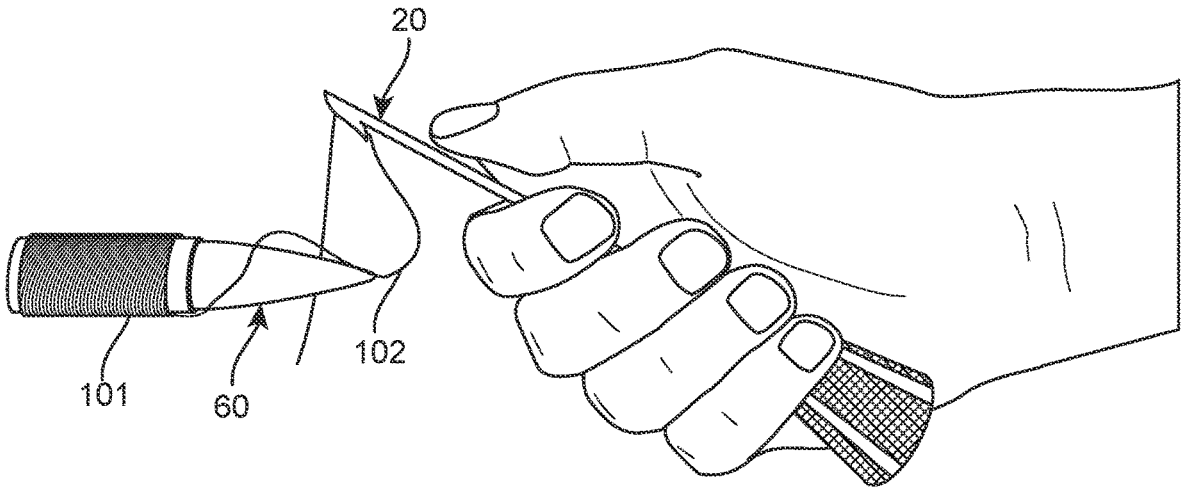
FIG. 7 depicts an operational view of the thread being pulled from the spool of thread.

The knife assembly 60 includes a knife 62 having a base 64 with a plurality of prongs 68 and a blade member 66. The knife 62 may be a dull-edge knife. The base 64 may have a cylindrical shape dimensioned to be inserted in an open distal end of a spool of thread 101. The base 64 may have, in a suitable embodiment, four prongs 68 made of a flexible material. In one embodiment, the prongs 68 may extend at an angle from a bottom surface of the base 64 opposite to the knife 62. The blade member 66 may be made of plastic, wood, metal, or any other variation thereof. The blade member 66 may have two opposing edges beginning at the connection to the base 64 and ending by forming a tip. The two opposing edges of the blade member 66 may be dulled to prevent the knife 62 from cutting threads from the spool or hairs from a client. In one embodiment, where the needle catches more threads than is intended there is a dull-edged knife 62 may be used to spilt the threads or remove the threads off of the harpoon tip 24 of the needle 22. The prongs 68 being from a flexible material allow a user to compress them to fit inside the spool 101 as depicted in FIGS. 4-6. This convenient design enables the knife assembly 60 to be attached to any spool 101 regardless its size and/or dimension of its central opening.

In FIG. 1, after braiding the hair, a weave can be positioned over the braid and secured with a clip to ensure stability. The precise placement of the clip depends on the braid pattern.

To begin the process, a knife (designated as 62) is inserted into the spool of thread (labeled as 101). With the non-dominant hand, the user pulls the required length of thread from the spool. This thread is looped and placed at the start of the braid, extending a predetermined distance beyond the secured portion of the braid.

With the dominant hand, the user grasps the handle (denoted as 42) and passes it under the weave track, positioning the looped thread on the harpoon tip (referred to as 24). By closing the harpoon tip, only the thread is pulled under the braid. Once the thread is drawn through, the harpoon tip is held at a second predetermined length, effectively creating two strands of thread.

Using the knife (62), the user passes it through the two strands of thread and loops it over the non-dominant hand, ultimately forming a knot. This process is repeated to achieve uniform stitches until the end of the braid is reached. For added reinforcement at the end of the braid, the user may loop it around the same stitch 3 or 4 times.

Upon completing the sewing-in process, any excess weave tracks can be trimmed. It's important to note that the spool of thread (labeled as 101) can vary in size, accommodating different attachment sizes as needed during manufacturing.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a hair tool, comprising:

a) a needle having a threaded bottom end and a harpoon-shaped tip disposed at a top distal end thereof, wherein said harpoon-shaped tip has a sharp upper end extending upwardly, wherein said harpoon-shaped tip has a harpoon sharp bottom portion extending outwardly, said needle further includes a flap hingedly attached to the needle, wherein said flap is proximal to said harpoon-shaped tip, said flap being larger in length than the harpoon-shaped tip entirely cover a gap between the harpoon-shaped tip and the flap when in a closed configuration;

b) a handle having a tapered shape, a narrow end of the handle includes a threaded hole to receive said threaded bottom end of said needle therein, wherein the handle has a meshed textured outer surface;

c) a knife assembly for splitting threads including a knife perpendicularly attached to a flat surface of a base, said base further includes flexible prongs extending downwardly at an outward angle from a bottom surface of the base, said flexible prongs are disposed opposite to said knife, the knife being a dull knife, said flexible prongs are compressed and inserted into an opening of a spool of thread housed in the handle, thereby attaching the knife assembly to said spool of thread.

2. A system for a hair tool, comprising:

a) a needle having a straight elongated body including a threaded bottom end and a harpoon-shaped tip disposed at a top distal end thereof, wherein said harpoon-shaped tip has a sharp upper end extending upwardly, wherein said harpoon-shaped tip has a harpoon sharp bottom portion extending outwardly, said needle further includes a flap hingedly attached to the needle, wherein said flap is proximal to said harpoon, said flap being larger in length than the harpoon-shaped tip to entirely cover a gap between the harpoon-shaped tip and the flap when in a closed configuration, when in an open configuration said harpoon-shaped tip is configured to engage threads of hair;

b) a handle having a tapered shape, a narrow top end of the handle includes a threaded hole to receive said threaded bottom end of said needle therein, said handle being hollow, wherein the handle has a meshed textured outer surface;

c) a knife assembly for splitting threads including a dull knife perpendicularly attached to a flat surface of a base, said base further includes flexible prongs extending downwardly at an outward angle from a bottom surface of the base, said prongs are disposed opposite to said knife, said prongs are compressed and inserted into an opening of a spool of thread housed in the handle, thereby attaching the knife assembly to said spool of thread.

3. A system for a hair tool, consisting of:

a) a needle having a straight elongated body including a threaded bottom end and a harpoon-shaped tip disposed at a top distal end thereof, wherein said harpoon-shaped tip has a sharp upper end extending upwardly, wherein said harpoon-shaped tip has a harpoon sharp bottom portion extending outwardly, said needle further includes a flap hingedly attached to the needle, wherein said flap is proximal to said harpoon, said flap being larger in length than the harpoon-shaped tip to entirely cover a gap between the harpoon-shaped tip and the flap when in a closed configuration, when in an open configuration said harpoon-shaped tip is configured to engage threads of hair, the harpoon tip has a curved portion extending diagonally upwards from the uppermost end thereof and a bottom cutout, flap, when in the opened configuration, extends diagonally from one of the sides of the needle;

b) a handle having a frustoconical shape, a narrow top end of the handle includes a threaded hole to receive said threaded bottom end of said needle therein, said handle being hollow, wherein the handle has a meshed textured outer surface;

c) a knife assembly for splitting threads including a dull knife perpendicularly attached to a flat surface of a base, said base further includes four flexible prongs extending downwardly at an outward angle from a bottom surface of the base, said four prongs are disposed opposite to said knife, said four prongs compressed, and inserted into an opening of a spool of thread housed in the handle, thereby attaching the knife assembly to said spool of thread, and wherein said dull knife has a tapered geometry.

4. The system for a hair tool of claim 1, wherein said flap is attached to said needle by means of a hinge disposed at a bottom distal end of the flap.

5. The system for a hair tool of claim 1, wherein said flap has an elongated curved shape so that when in closed configuration the needle exhibits a continuous contour.

6. The system for a hair tool of claim 1, wherein said flap has an open configuration in which the harpoon-shaped tip is exposed for the harpoon tip to catch threads of hair.

7. The system for a hair tool of claim 1, wherein said handle is hollow.

8. The system for a hair tool of claim 1, wherein said flexible prongs are made of a flexible material to be compressed and inserted into the opening of the spool of thread, wherein the flexible prongs secure the knife assembly to the spool.

9. The system for a hair tool of claim 1, wherein the flexible prongs extend at an angle from the bottom surface of the base.

10. The system for a hair tool of claim 1, wherein the base is dimensioned to be received by the opening of the spool of thread.

* * * * *